United States Patent [19]

Oda et al.

[11] 3,991,559

[45] Nov. 16, 1976

[54] APPARATUS FOR GENERATING HIGH-PRESSURE GAS

[75] Inventors: Noriyuki Oda; Takashi Yoshida; Takeshi Nakanishi; Kensuke Yoshikawa, all of Osaka, Japan

[73] Assignee: Hitachi Shipbuilding and Engineering Co., Ltd., Osaka, Japan

[22] Filed: July 16, 1975

[21] Appl. No.: 596,481

[30] Foreign Application Priority Data

Oct. 7, 1974 Japan ..... 49-115796

[52] U.S. Cl. ..... 60/39.46 R; 60/39.55; 60/39.48

[51] Int. Cl.² ..... F02C 3/20; F02C 7/22

[58] Field of Search ..... 60/39.46 R, 216, 218, 60/DIG. 9

[56] References Cited

UNITED STATES PATENTS

| | | | |
|---|---|---|---|
| 3,328,957 | 7/1967 | Rose | 60/39.46 |
| 3,771,313 | 11/1973 | Kaiho et al. | 60/39.46 |

*Primary Examiner*—Carlton R. Croyle
*Assistant Examiner*—L. J. Casaregola
*Attorney, Agent, or Firm*—Allison C. Collard

[57] ABSTRACT

High-pressure gas generating apparatus includes a combustion engine and a metal fuel storage chamber surrounding the combustion chamber. The combustion chamber has at its one end a metal fuel injecting orifice and water injecting orifices. The fuel injecting orifice communicates with the fuel storage chamber, and the water injecting orifices communicate with a water heating tube extending helically in the interior of the combustion chamber.

6 Claims, 2 Drawing Figures

APPARATUS FOR GENERATING HIGH-PRESSURE GAS

BACKGROUND OF THE INVENTION

This invention relates to an apparatus for generating a high-pressure gas, and more particularly to an apparatus by which a fuel mainly comprising lithium, magnesium, aluminum, boron or like light metal or a compound thereof is reacted in molten state with water by contact therewith to produce a high-temperature high-pressure combustion gas for use as driving energy for turbines or the like to propel self-propelling submarine bodies.

Self-propelling submarine bodies require a high-pressure gas generator which is compact in its entirety and has a high gas generating efficiency.

SUMMARY OF THE INVENTION

This invention provides an apparatus for generating a high-pressure gas fulfilling the above requirement. The apparatus comprises a combustion chamber having at its one end a metal fuel injecting orifice and water injecting orifices, and a metal fuel storage chamber surrounding the combustion chamber and communicating with the fuel injecting orifice, whereby the heat of combustion reaction in the combustion chamber is advantageously utilized to melt the metal and to maintain the fuel in molten state. Because the apparatus does not include a separate heater necessary to heat the metal fuel when the fuel storage chamber is disposed away from the combustion chamber, the overall construction which can be simplified consequently renders the entire apparatus compact. The water to be reacted with the metal fuel is led to the water injecting orifices through a heating tube provided in the combustion chamber and communicating with the water injecting orifices and can therefore be injected into the combustion chamber after it has been heated to a high temperature through heat exchange with the heat of reaction within the combustion chamber. Thus this construction permits the water to react with the fuel with an improved efficiency, leading to a higher gas generating efficiency.

This invention will be described below in greater detail with reference to the accompanying drawings.

DESCRIPTION OF THE PREFERRED EMBODIMENT

Figure 1:
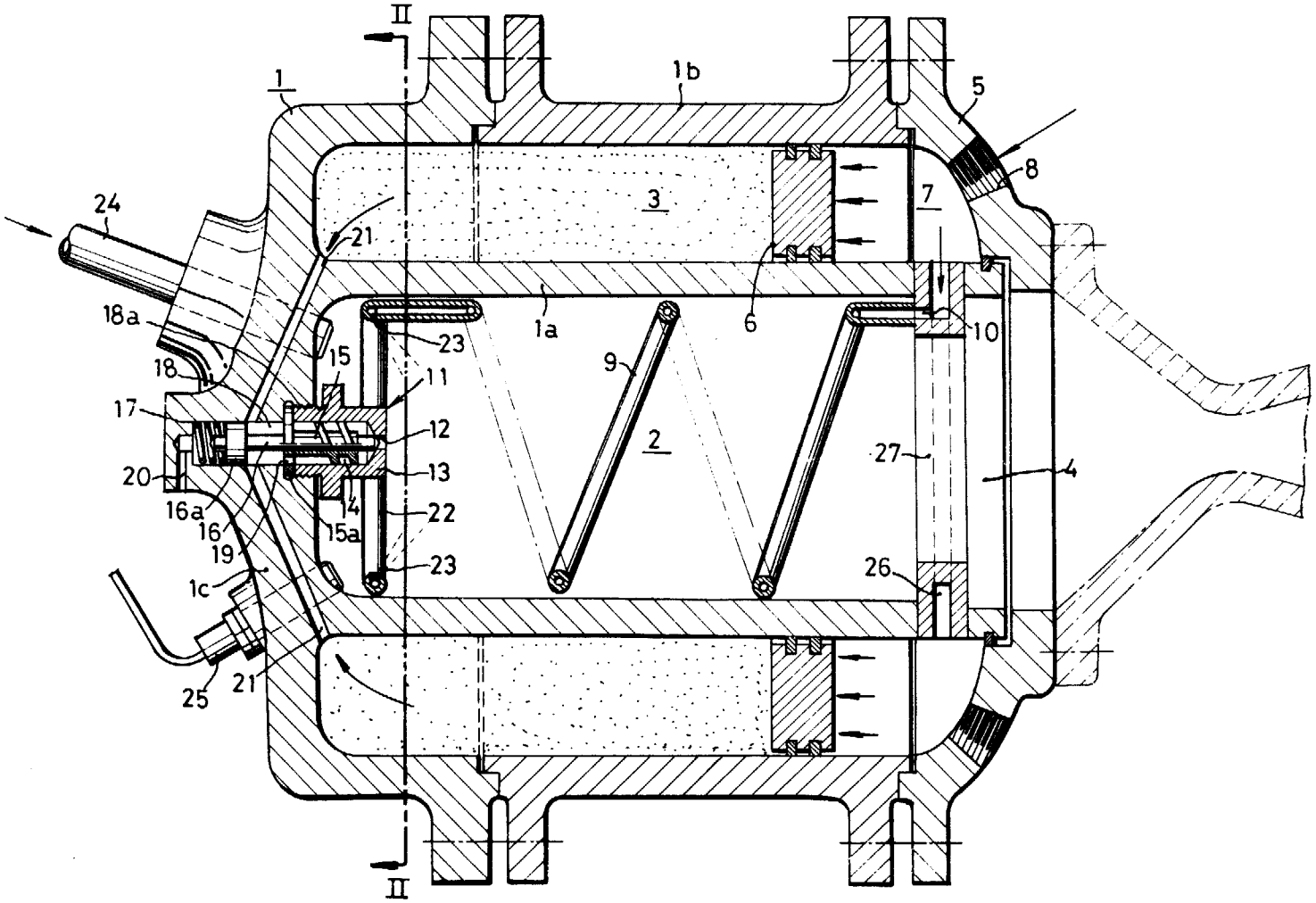
FIG. 1 is a vertical view of a high-pressure gas generator according to this invention.
Figure 2:
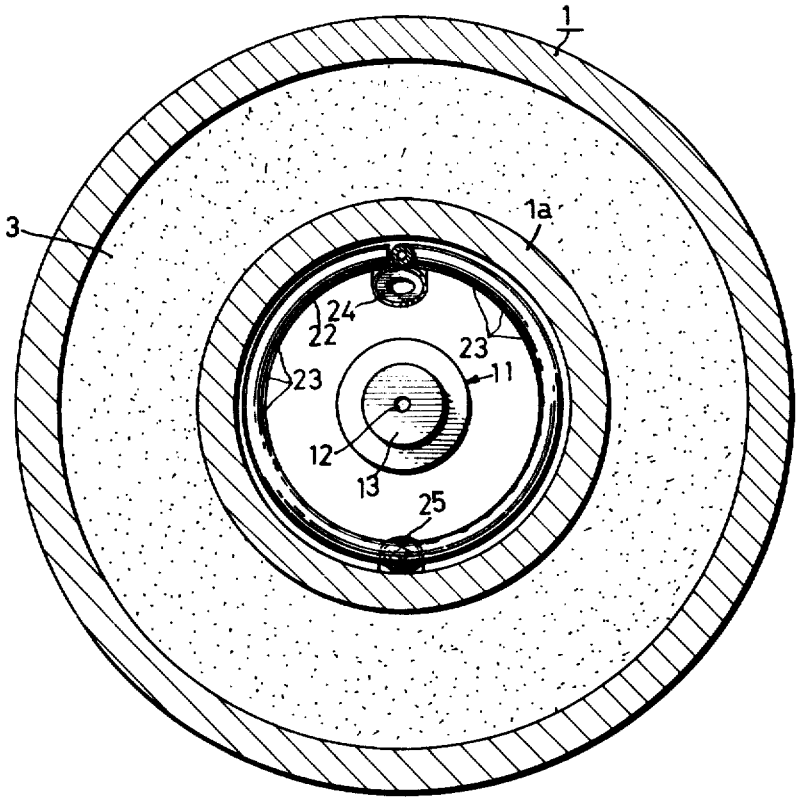
FIG. 2 is a view in section taken along the line II—II in FIG. 1.

Throughout the specification and claims, the right-hand side of the drawing will be referred to as "front" and the left-hand side of the same as "rear".

With reference to the drawings, a gas generator body 1 comprises a double peripheral wall including an inner peripheral wall 1*a* and an outer peripheral wall 1*b*, each circular in cross section. The inner peripheral wall 1*a* defines a combustion chamber 2. The space between the inner peripheral wall 1*a* and the outer peripheral wall 1*b* serves as a fuel storage chamber 3 which is annular in cross section. Both the chambers 2 and 3 are closed, at their rear ends, with the rear wall 1*c* of the generator body 1. The front end of the combustion chamber 2 is open to provide a combustion gas outlet 4. The front end of the storage chamber 3 is closed with an annular front wall 5 and is watertight. A fuel pressing annular piston 6 is disposed in the storage chamber 3, and a pressure chamber 7 formed in front of the piston 6 communicates, through water inlets 8 in the front wall 5, with a water supply for feeding water under pressure. A water heating tube 9 helically extends along, and is secured to, the inner surface of the inner peripheral wall 1*a*. The front end of the tube 9 communicates with the pressure chamber 7 by way of a passage 10 in an annular member 27 having an annular groove 26 and positioned at the front end of the inner peripheral wall 1*a*.

A metal fuel injector 11 provided in the rear end central portion of the combustion chamber 2 comprises an injector housing 13 U-shaped in vertical section and having a fuel injecting orifice 12 in its front end, a swirler 15 intimately fitted in the housing 13 to define a fuel swirling passageway 14, a needle valve 16 slidably extending through a center bore in the swirler 15 and adapted to open or close the orifice 12, and a spring 17 always biasing the needle valve 16 in the direction to close the orifice 12. The injector housing 13 is screwed at its rear end into the internally threaded front end 18*a* of a blind bored portion 18 formed in the rear wall 1*c* and opened to the combustion chamber 2, the injector housing 13 projecting into the combustion chamber 2. The swirler 15 has at its rear end a flange 15*a*, which is pressed by the rear end of the injector housing 13 against the stepped part of the bored portion 18, whereby the swirler 15 is held in position. The flange 15*a* has a plurality of ports 19. Mounted on the rear end of the needle valve 16 is a piston 16*a* slidable along the inner surface of the bored portion 18. The spring 17 bears at its opposite ends against the rear surface of the piston 16*a* and the bottom wall of the bored portion 18. An air vent 20 extends from the rear end of the bored portion 18. Each of a number of radial fuel passages 21 formed in the rear wall 1*c* has one end opened to the fuel storage chamber 3 and the other end opened, to the front of the piston 16*a*, to the bore 18. The rear end of the heating tube 9 is integral with an annular water injecting tube 22 having a number of water injecting orifices 23 in its tube wall at specified spacing. The injector housing 13 is positioned in the center of the annular tube 22, such that the water forced through the heating tube 9 will jet from all sides of the fuel injecting orifice 12 toward the centerline of the combustion chamber 2. For this purpose, the orifices 23 are directed toward the direction of injection of the metal fuel slightly obliquely forward. To cause the injected water to form a swirling stream within the combustion chamber 2, the orifices 23 may further be directed obliquely in the circumferential direction of the inner peripheral wall 1*a*. An initiator inlet tube 24 extends, as inclined forwardly downward, through an upper portion of the rear wall 1*c* into the combustion chamber 2. In opposing relation to the inlet tube 24, an igniter 25 extends into the combustion chamber 2 obliquely upward toward the front through a lower portion of the rear wall 1*c*.

To operate the high-pressure gas generating apparatus, liquid hydrogen or like initiator fuel and liquid oxygen or like oxidizing agent are introduced into the combustion chamber 2 through the initiator inlet tube 24 at the same time, and the fuel is ignited by the igniter 25. The initiator is subjected to combustion reaction for the required period of time to partially melt the metal fuel in the storage chamber 3 with the resulting heat of reaction. Subsequently the water to be reacted with the fuel is forced into the pressure chamber 7 through the inlets 8. The hydraulic pressure thus applied to the piston 6 presses the metal fuel, forcing a molten portion thereof through the fuel passages 21 into the injector 11. Although the needle valve 16 in the injector 11 acts to always close the orifice 12, thereby impeding the flow of combustion gas into the storage chamber 3 and preventing degradation, especially oxidation, of the metal fuel, the molten metal fuel forced into the bore 18 pushes the piston 16*a*, retracting the needle valve 16 against the action of the spring 17, and opens the fuel orifice 12. Consequently, the molten metal fuel flows through the passageway 14 in the form of a swirling stream, egressing from the orifice 12 in the form of a conical jet of fine droplets. Simultaneously with this, on the other hand, the water in the pressure chamber 7 flows through the passage 10 and then through the heating tube 9, while thereby being heated to a high temperature through heat exchange with the combustion heat in the chamber 2, and jets from the orifices 23 in the tube 22. The water thus injected comes into contact with the metal fuel within the combustion chamber 2, vigorously reacting therewith to generate a large amount of high-temperature high-pressure combustion gas. Although the introduction of initiator through the inlet tube 24 is thereafter discontinued, the metal fuel is melted with the combustion heat within the chamber 2, and the molten fuel is continuously injected from the orifice 12, whilst the water, heated to a high temperature, is also continuously forced out from the orifices 23. Combustion gas is therefore continuously generated. The combustion gas is forced out from the outlet 4 and is utilized as energy for driving a turbine or the like.

To stop the operation, charge of water into the pressure chamber 7 is discontinued, whereupon the spring 17 pushes the needle valve 16 forward and thereby closes the fuel injecting orifice 12. Accordingly, injection of the fuel is terminated, while injection of water is also discontinued.

The initiator inlet tube 24 may be connected to a high-temperature gas generator outside the apparatus so that a high-temperature gas separately prepared can be introduced into the combustion chamber 2 for the initiation of operation. In this case, the igniter 25 of course need not be provided in the apparatus.

What is claimed is:

1. An apparatus for generating a high-pressure gas comprising a gas generator body including a combustion chamber and a metal fuel storage chamber surrounding the combustion chamber, said gas generator body including an inner peripheral wall and an outer peripheral wall defining the combustion chamber and the metal fuel storage chamber, a rear wall closing the rear ends of the combustion chamber and the storage chamber, and a front wall having an opening at the front end of the combustion chamber to provide a combustion gas outlet and closing the front end of the storage chamber, metal fuel injecting means provided at one end of the combustion chamber and communicating with the storage chamber, said metal fuel injecting means comprising an injector U-shaped in vertical section and having a metal fuel injecting orifice in its front end, a swirler intimately fitted in the injector housing to form a fuel swirling passageway, a needle valve having a piston on the rear end thereof and slidably extending through a center bore in the swirler to open or close the orifice, and a spring biasing the needle valve in the direction to close the orifice, the injector housing being fitted in the front end of a blind bored portion formed in the center of the rear wall and open to the combustion chamber, the bored portion communicating with the storage chamber through passages, the piston being positioned to the rear of the passages, the spring bearing at its opposite ends against the rear surface of the piston and the bottom wall of the bored portion, water injecting means disposed in the combustion chamber, and a water heating tube disposed within the combustion chamber and communicating with the water injecting means, so that the heat of combustion reaction within the combustion chamber melts the metal fuel in the storage chamber and heats the water passing through the tube.

2. An apparatus as defined in claim 1 wherein the water injecting means comprises an annular water injecting tube having a number of water injecting orifices at specified spacing and integral with the rear end of the heating tube for forcing the water therethrough, and the injector housing is positioned in the center of the annular injecting tube.

3. An apparatus as defined in claim 2 wherein the orifices in the water injecting tube are directed obliquely forward toward the direction of injection of the metal fuel from the injector housing.

4. An apparatus as defined in claim 3 wherein the water injecting orifices are further directed obliquely in the circumferential direction of the inner peripheral wall to cause the water injected therefrom to form a swirling stream within the combustion chamber.

5. An apparatus for generating a high-pressure gas comprising a gas generator body including a combustion chamber and a metal fuel storage chamber surrounding the combustion chamber, the gas generator body having an inner peripheral wall and an outer peripheral wall defining the combustion chamber and the metal fuel storage chamber, a rear wall closing the rear ends of the combustion chamber and the storage chamber, and a front wall having an opening at the front end of the combustion chamber to provide a combustion gas outlet and closing the front end of the storage chamber, the front wall further having a water inlet, the rear wall being provided in its center with metal fuel injecting means including an injector housing U-shaped in vertical section and having a metal fuel injecting orifice in its front end, a swirler intimately fitted in the injector housing to form a fuel swirling passageway, a needle valve having a piston on the rear end thereof and slidably extending through a center bore in the swirler to open or close the orifice, and a spring always biasing the needle valve in the direction to close the orifice, the injector housing being fitted in the front end of a blind bored portion formed in the center of the rear wall and open to the combustion chamber, the bored portion communicating with the storage chamber through passages, the piston being positioned to the rear of the passages, the spring bearing at its opposite ends against the rear surface of the piston and the bottom of the bored portion, the inner wall being provided with a water heating tube helically extending therealong and integral at its rear end with an annular water injecting tube having a number of water injecting orifices at specified spacing, the injector housing being positioned in the center of the annular injecting tube, the storage chamber having an annular piston fitted therein and positioned closer to the front of the storage chamber, the piston defining to the front thereof a space serving as a pressure chamber communicating with the water inlet, the water heating tube being in communication with the pressure chamber.

6. An apparatus as defined in claim 5 wherein an initiator inlet tube and an igniter extend through the rear wall into the combustion chamber.

* * * * *